US005400692A

United States Patent [19]

Bateman

[11] Patent Number: 5,400,692

[45] Date of Patent: Mar. 28, 1995

[54] BULLET STOP AND CONTAINMENT CHAMBER

[76] Inventor: Kyle E. Bateman, P.O. Box 636, Provo, Utah 84603-0636

[21] Appl. No.: 204,682

[22] Filed: Mar. 1, 1994

[51] Int. Cl.[6] ..... F41J 1/12

[52] U.S. Cl. ..... 89/36.02; 273/410

[58] Field of Search ..... 89/36.02; 273/410, 404

[56] References Cited

U.S. PATENT DOCUMENTS

| | | | |
|---|---|---|---|
| 385,546 | 7/1888 | Decumbus | 273/404 |
| 694,581 | 3/1902 | Reichlin | 273/404 |
| 840,610 | 1/1907 | Easdale | 273/404 |
| 2,013,133 | 9/1935 | Caswell | 273/410 |
| 2,201,527 | 5/1940 | Freeman | 273/404 |
| 2,420,304 | 5/1947 | Diem | 273/410 |
| 2,772,092 | 11/1956 | Nikoden | 273/410 |
| 3,701,532 | 10/1972 | Nikoden | 273/410 |
| 3,737,165 | 6/1973 | Pencyla | 273/102.4 |
| 4,126,311 | 11/1978 | Wagoner | 273/102.4 |
| 4,512,585 | 4/1985 | Baravaglio | 273/410 |
| 4,821,620 | 4/1989 | Cartee et al. | 89/36.02 |
| 5,070,763 | 12/1991 | Coburn | 89/36.02 |
| 5,113,700 | 5/1992 | Coburn | 89/36.02 |
| 5,121,671 | 6/1992 | Coburn | 89/36.02 |
| 5,259,291 | 11/1993 | Wilson | 89/36.02 |

*Primary Examiner*—David Brown
*Attorney, Agent, or Firm*—Thorpe, North & Western

[57] ABSTRACT

A bullet stop and containment chamber for stopping the forward momentum of projectiles traveling in a generally horizontal zone of projectile travel. The bullet enters the wide end of a channel having plates which guide the bullet into a narrow opening which leads into a containment chamber. The containment chamber has a series of plates arranged with increasing angles of incidence such that the sequential impacts are increasingly direct. There are also side plates on the chamber which combine with the other structure to confine bullets, fragments and particulate matter to the chamber until inertial momentum is arrested and the bullet drops out of an egress.

15 Claims, 3 Drawing Sheets

BULLET STOP AND CONTAINMENT CHAMBER

BACKGROUND

1. Field of the Invention

The present invention relates generally to apparatus for deceleration of projectiles, and containment of those projectiles and their fragments and particulate resulting therefrom. More particularly, it concerns apparatus for guiding a projectile into a chamber where successive armor plates contain the projectile within a confined area. The bullets, fragments and resulting particulate matter are then collected and confined for disposal or recycling.

2. Background Art and Background of the Invention

It is understood that when a bullet or other projectile hits a surface it has a propensity to deform. This is particularly true for lead bullets hitting hard surfaces, as is often the case in target practice with small arms. This deformation is frequently in the form of fragmentation of the projectile into smaller components, even to the point of generation of airborne particulate matter. The terms "bullet" and "projectile" are used broadly herein. They mean the original body as placed in motion, as well as any fragments or particulate matter formed upon primary and subsequent impacts of the projectile and its fragments, as well portions of other projectiles which may be set in motion on impact with the projectile or its fragments. The terms "bullet" and "projectile" are used interchangeably.

Target practice is an activity pursued by many to enhance shooting skills, as criteria of employment, or for sport. It is customary in target practice to provide a means of stopping projectiles after they have traveled through or by a target, and before their potential to harm persons or damage property is concluded. This is traditionally accomplished by such means as providing adequate proximity between the target and persons and property, constructing a barrier such as an earthen berm, or strategically locating a solid fixture such as a wall or a metal plate. Proximity solutions involve massive facilities in light of modern weapons with long and powerful trajectories. This wastes valuable land resources and requires time consuming travel to less populated areas.

Merely providing an earthen or other barrier may stop the bulk of the projectiles, but has no effect on the indiscriminate distribution of lead, the primary material used for projectiles, into the environment. Lead is a heavy metal environmental contaminant increasingly implicated as a health risk to humans and animals.

Barriers are subject to wear and eventual failure. Simple barriers and fixtures may stop a projectile, but allow lead fragments or particulate to escape into the environment. Barriers without containment deflect bullets which may retain enough velocity to harm bystanders, the shooter, or property. These barriers still require a significant proximity solution due to deflected projectiles. Barriers without containment loose the bullets to the surrounding environment and disallow recycling the matter into new projectiles or other usable goods.

The term "plate" is used herein in its broadest sense as a planar sheet of material capable of stopping or deflecting a projectile and its fragments. It will be understood by those of ordinary skill in the art, that selection of plate material is made in consideration of the nature and velocity of the various projectiles to be stopped and contained. For high velocity, high mass, jacketed bullets, the material of choice may be hardened steel plate or the equivalent; for projectiles from small air guns, a material with less impact resistance may be chosen. Similarly, plates intended to take primary, direct impacts will necessarily be stronger than those to take secondary or tertiary impacts from more acute angles.

Recent emphasis has been placed on stopping and containing projectiles by the use of bullet traps and stops, and containment systems employing a variety of configurations intended to stop a projectile and contain the resultant products. For example in U.S. Pat. No. 4,821,620, to Cartee et al. (1989), it is described to provide a screen of rubber-like material followed by a deflector plate. The bullet is said to travel through the screen and be stopped by the plate, bullets and fragments then are said to fall down between the two components to a collector. This has the particular disadvantages of wear of the rubber-like material, increasingly diminished margins of containment with wear, the likelihood of escape of projectiles back through the screen with enough energy to cause harm to persons or property, and the inability to significantly contain airborne particulate matter from the projectiles.

Others including Bravaglio in U.S. Pat. No. 4,512,585 (1985), and Coburn U.S. Pat. No. 5,070,763 (1991), describe containment chambers with curved portions said to reduce the velocity of projectiles as they travel along the curved surface. However, curved plate is costly to manufacture, transport, store, and assemble. It is very bulky as compared to flat plate. Virtually all of the energy from projectiles over time in these devices is absorbed in a very limited area of the curved or otherwise complex structure in these chambers, necessitating expensive repair, reconstruction, or replacement. Bullet stops with curved portions are said to have the advantage of maintaining the integrity of the projectile, thereby preventing the escape of fragments and particulate matter from the normal pathway. In practice, high velocity projectiles fragment on impact, explode from the forces of angular velocity upon rotation, or melt.

Another problem yet unsolved by the prior art is containment of fine fragments and particulate matter created on impact without the problems associated with curved plate and other complex arrangements. Prior art devices have traditionally focused on directing projectiles and large fragments away from persons and property. For example U.S. Pat. No. 3,737,165 to Pencyla (1973), describes a device which is said to employ a series of deflector plates to direct projectiles and fragments rearwardly and downwardly in proximity to a back plate where gravity and any remaining velocity on a vector parallel to the back plate guides them to a collection area. High velocity projectiles impacting the deflector plates at an oblique angle, as described, create a fragmented lead and lead particulate that escape to the surrounding environment, because no means of containment are provided.

As is described in U.S. Pat. No. 3,737,165 to Pencyla (1973), there is a need in the prior art to provide bullet stops which can be arranged in horizontal series, as in a range. A recognized limitation is supporting deflection and containment plates and structure without creating barriers within the zone traveled by projectiles, i.e. vertical support members. For example, the vertical support holding a deflection plate would necessarily be engineered to withstand sustained impact by all classes of projectiles used in the range, as the support is within the zone traveled by those projectiles.

This problem is said to be solved by Pencyla by arranging the bullet stop on a large vertical surface of a wall. This arrangement has the distinct disadvantages of not containing the projectiles after initial impacts. Particulate matter and fragments may freely escape in the opposite direction of the original trajectory after secondary and tertiary impacts. Others have attempted to solve this problem with complex arrangements of curved plate and funnel-type arrangements which, as discussed above, are difficult and costly to manufacture, transport, store, and assemble.

There is thus a need to provide a bullet stop and containment chamber in which bullets are guided to a primary impact which absorbs the bulk of the energy from the bullets, and the impact occurs on a relatively small and readily replaceable component; a bullet stop which is constructed from flat, storable, transportable, and readily constructable stock plate components; which provides a defined containment chamber capable of retaining small projectile fragments and lead particulate; and which can be arranged in horizontal series without vertical support which inhibits the general path of trajectory of the range or which requires engineering to withstand the same.

Those having ordinary skill in the art will appreciate that these and other needs are met by the present invention.

OBJECTS AND SUMMARY OF THE INVENTION

It is therefore an object of the present invention to provide a bullet stop and containment chamber with a defined containment chamber to prevent the escape of bullets, fragments and particulate matter having any significant residual inertial momentum.

It is an additional object of the invention to provide such bullet stop and containment chamber which can be constructed from flat plates which can be stocked and inventoried and which are relatively transportable.

It is another object of the invention to provide such bullet stop and containment chamber which can be assembled and serviced on site.

It is also an object of the invention to provide such bullet stop and containment chamber in which the primary wear is focussed on readily replaceable parts.

It is a further object of the invention to provide such bullet stop and containment chamber which can be assembled in series without obstruction of the zone of projectile travel by vertical support structure.

The above objects and others not specifically recited are realized in a specific illustrative embodiment of a bullet stop and containment chamber for arresting the inertial momentum of projectiles traveling in a generally horizontal zone of projectile travel. Projectiles enter the wide end of a channel having plates which guide them into a narrow opening which leads into a containment chamber.

The containment chamber has a series of plates arranged with increasing angles of incidence such that sequential impacts of projectiles and their progeny are increasingly direct with impact plates. There are also side plates on the chamber which combine with the other structure to confine bullets, fragments and particulate matter in the chamber until inertial movement ends and the bullet drops out of an egress.

At least the upper plate of the channel is supported from above by a cantilever. The cantilever is supported at the distal end by supports either integral with the containment chamber or in common with it. Because there is no support extending vertically through the zone of projectile travel, an unlimited number of modules as described herein can be arranged in horizontal series, thus providing a range in which many target shooters can fire projectiles in the same general direction without the trajectories of their bullets being interrupted by support structure. Similarly, there is no support structure to be damaged within the series by projectiles traveling along a generally horizontal path of travel, but which may be inadvertently fired on a trajectory not perpendicular to the opening in the containment chamber.

The impact plates are arranged such that the first plate absorbs the primary impact at an acute angle, the next at a less acute angle and so on until the bullets and fragments strike a final impact plate at a more or less perpendicular angle. The first impact plate is protected from wear by the acute angle of impact as well as attachment to the containment chamber in a moveable fashion such that, upon impact by a projectile, it absorbs some of the energy in the form of displacement of the plate. This arrangement can also be used in subsequent impact plates if needed. The first impact plate is removable and readily replaceable on-site by simply sliding it out of position and replacing it with another. Other plates are similarly user-serviceable.

The chamber is enclosed with the exception of the ingress from the channel and an egress extending from the bottom of the chamber in an overlap between the two lowest plates. This allows the bullets, fragments, and particulate matter to drop through into a pan or tray for collection and recycling.

Containment in this manner prevents the escape of particulate matter or lead dust into the range environment, and prevents the escape of bullets or fragments from traveling out of the chamber and harming persons or property. This containment also obviates the need for proximity-based protection of persons and property, thus conserving space and safely allowing ranges in areas with otherwise prohibitive land values.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE PREFERRED EMBODIMENT OF THE PRESENT INVENTION

Figure 1:
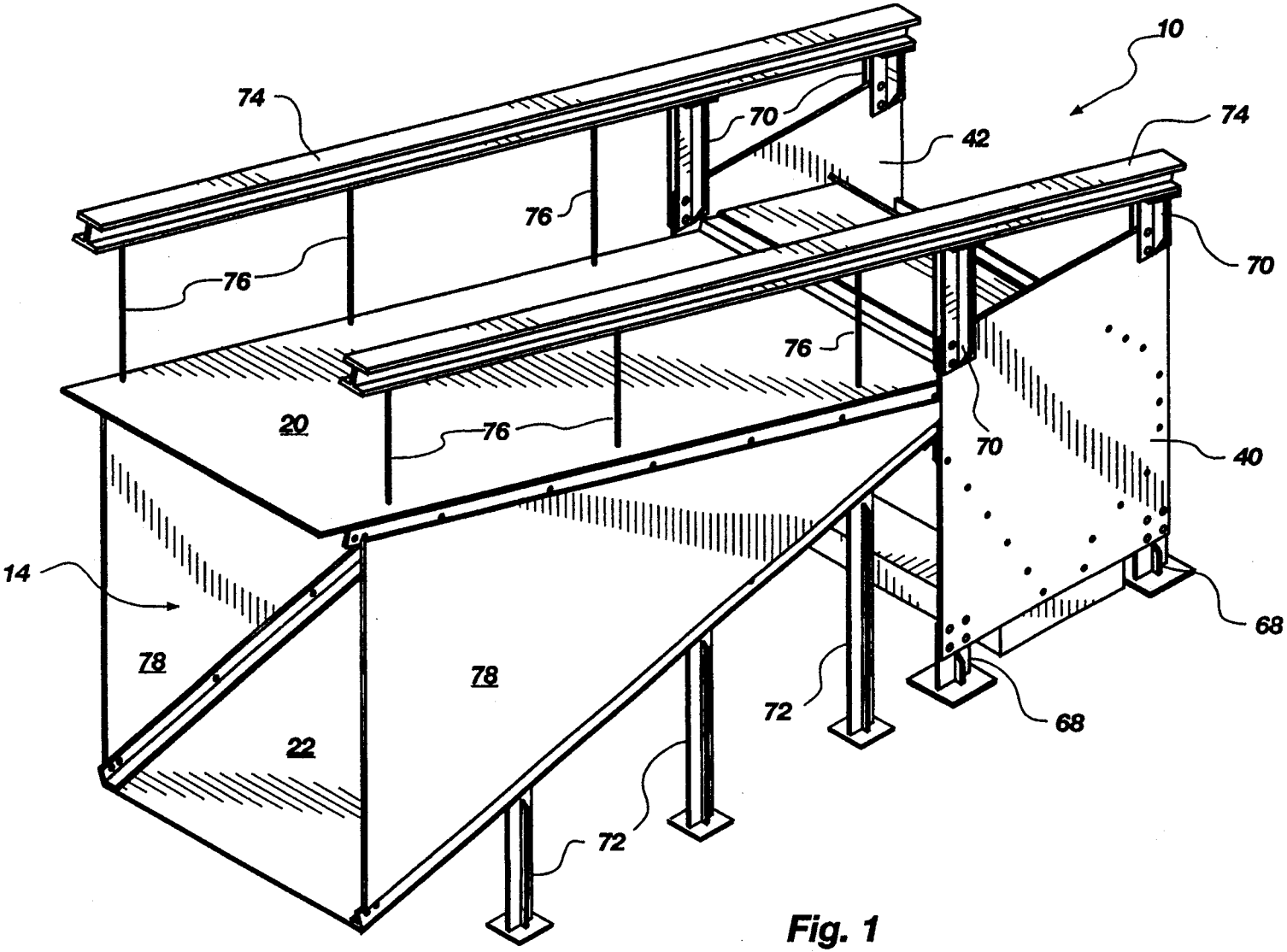
FIG. 1 is a perspective view of a bullet stop and containment chamber made in accordance with the principles of the present invention.

Reference will now be made to the drawings wherein like structures will be provided with like reference numerals.

Figure 2:
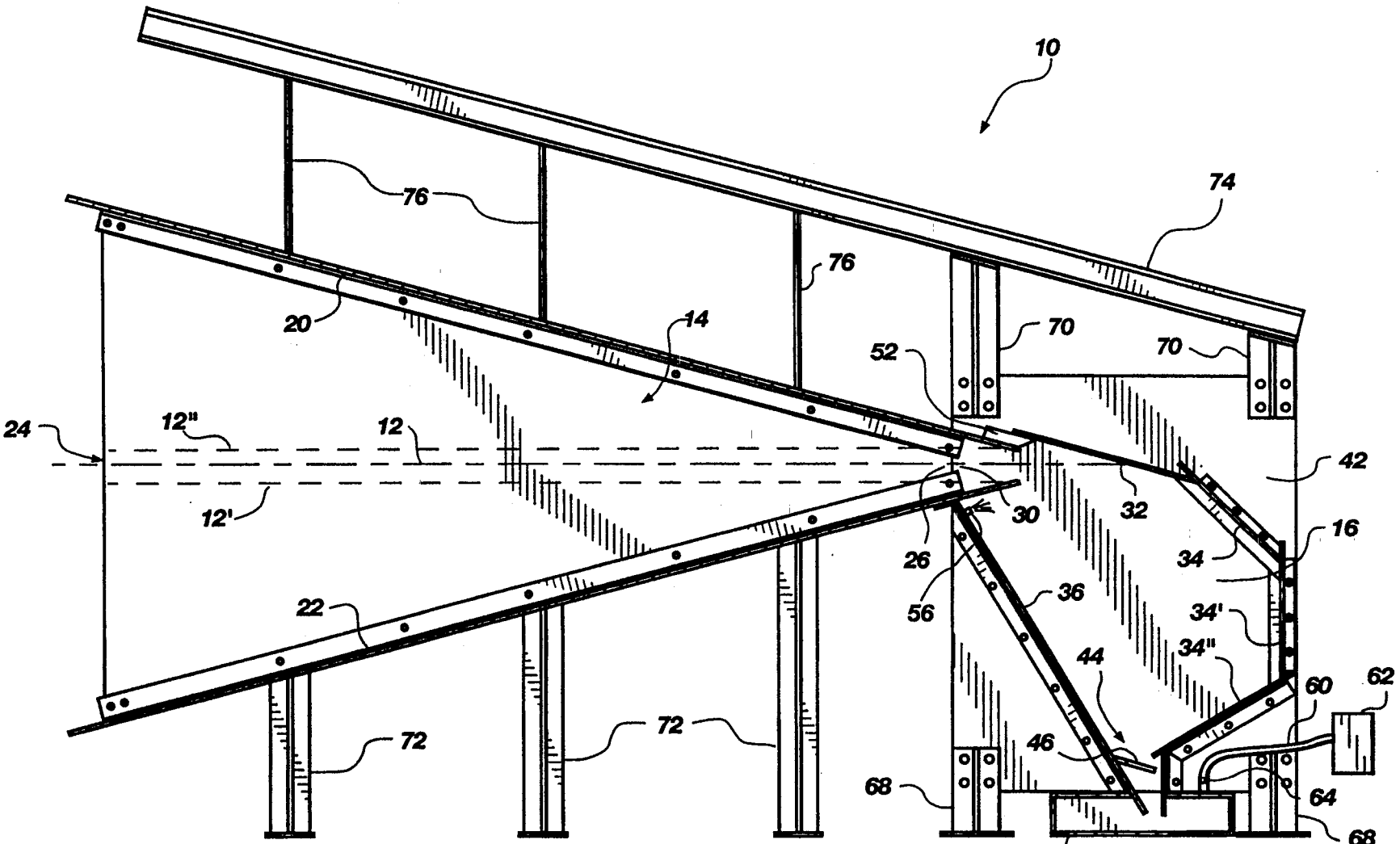
FIG. 2 is a side cross sectional view of the bullet stop and containment chamber of FIG. 1 taken along a vertical midline.

Referring to FIGS. 1–2, there is shown, generally designated at 10, a bullet stop and containment chamber for stopping the forward momentum of projectiles traveling in a generally horizontal zone of projectile travel 12. The bullet stop and containment chamber comprises generally a channel 14 and a containment chamber 16.

The channel has an upper plate 20 and a lower plate 22 arranged on complementary acute angles to the generally horizontal zone of projectile travel 12. As a bullet is fired it travels from the wide opening in the channel 24, to a narrow opening 26. If a projectile is on a trajectory 12' which is lower than the narrow opening 26 it is deflected by the lower plate of the channel 22 back into a conforming path 12. If a projectile is on a trajectory 12" which is higher than the narrow opening 26 it is deflected by the upper plate of the channel 20 back into a conforming path 12. In any event, the projectile is guided into the narrow opening 26 by the plates which are at generally acute angles (10°–30° but optimally 15°) to horizontal, so that the projectile remains in tact while traveling through the channel and into the chamber.

The narrow opening of the channel 26 is substantially coextensive with an ingress 30 to the chamber. As the projectile travels through the ingress 30 it impacts with the primary impact plate 32. The impact plate 32 is at an equal or greater angle of incidence with the generally horizontal zone of projectile travel 12 so that the impact with the plate 32 is of equal or greater force than the general impact the projectile may have had with either the upper 20 or lower 22 channel plate. The result of projectile impact with the primary impact plate 32, is that the bullet or fragments thereof are deflected in the general direction of the first in a sequence of impact plates 34 which is of an increased angle of incidence, than the primary impact, with the general deflected path of travel of the projectile or its progeny. Subsequent impact plates 34'–34" are of marginally increasing angles of incidence with each subsequent deflected angle of projectile travel. For example, in the preferred embodiment the upper plate 20 of the channel 14 and lower plate 22, are at complementary angles of approximately 16° from the generally horizontal zone of projectile travel 12; the primary impact plate 32 is on a similar angle to the generally horizontal zone of projectile travel 12; the angle formed between the primary impact plate 32, and the first sequential impact plate 34 is 150°; the angle formed between the first sequential impact plate 34 and the second sequential impact plate 34' is 128°; the angle formed between the second sequential impact plate 34' and the third sequential impact plate 34" is 108°; and the angle formed between the third sequential impact plate 34" and the terminal impact plate 36 is 90°. At each turn the projectile is subjected to increasingly direct impacts, but having less inertial momentum, the respective plate is able to withstand the increased directness. Therefore, as the projectile looses its inertial momentum, an increasingly large potential for stopping the projectile is encountered via a subsequent and more direct impact plate.

The terminal impact plate 36 terminates adjacent the chamber ingress 30. Thus, the impact plates 32–36 form a series of more or less continuous impact surfaces extending from the top of the chamber ingress 30, to the bottom of the chamber ingress 30.

At each end of the series of continuous impact surfaces formed by the impact plates 32–36, there are disposed a first end plate 40 and a second end plate 42. In combination the impact plates 32–36 and the end plates 40 and 42, form a continuous chamber 16. Ingress of projectiles occurs through the chamber ingress 30 already described. Once a projectile enters the chamber 16 it sequentially impacts the impact plates 32–36 as described hereinabove. After projectiles loose their inertial momentum they are obviously acted upon by gravity in such a way as to tend toward the lowest point of the chamber. In this embodiment the lowest point in the chamber is defined by the third sequential impact plate 34" and the terminal impact plate 36. The third sequential impact plate 34" and the terminal impact plate 36 slope together to define an egress 44 to the chamber. In this embodiment a check plate 46 is disposed at the egress to further prevent the inadvertent fragment from escaping the chamber with significant inertial momentum. It will be appreciated by those of ordinary skill in the art that the same effect can be accomplished by the overlap of the plates in such a way as to allow egress of a gravity-driven projectile but not of a projectile moving under inertial forces. Where, as in this embodiment, the egress is directed to the floor of the facility and to a collection tray 54 (later described), both of which may be designed to withstand the incidental impacts from projectiles on atypical trajectories within the chamber, it may not be necessary to cover the egress 44 with a check plate 46.

The plates described are attached to each other by means known in the art, i.e. securely bolting angle iron to the respective plates on surfaces outside the chamber or channel. Plates may also be interconnected in the original manner described in my U.S. patent application, Ser. No. 08/008,792, which I adopt and incorporate herein by reference.

Exceptions to rigid attachment of the plates are with regard to attachment of the primary 32 and first sequential 34 impact plates, which have been found to take the bulk of the impact forces from projectiles. For this reason, in the preferred embodiment these plates are movably fixed to the containment chamber 16. The primary impact plate 32 rests on an extension 52 of the upper channel plate 20, on its edge proximal to the upper channel plate, and, on the distal edge on extensions from structure associated with the first sequential impact plate 34 and end plates 40 and 42. The first sequential impact plate 34 is bolted to the rest of the structure as depicted, but the bolts are loosely fixed to allow movement of the plate on impact. The bolts may be tightened if the first sequential impact plate 34 shows substantial wear under actual use conditions, or if the increased energy absorption qualities are not found to be needed under the conditions of use. This arrangement allows for easy replacement of the primary impact plate 32 upon wear. Because the primary impact plate 32 moves with impact it absorbs a great deal of the energy of projectiles entering the chamber. This reduces wear on the other impact plates 34–36 and the end plates 40 and 42, thus extending the service life of the chamber 16. If a part is found to wear it can be readily replaced from appropriate plate stock, unlike formed and integral or complex chambers. An additional advantage is that the other chamber parts can be constructed from less impact resistant, and thus, less costly and bulky materials.

It will be appreciated by those of ordinary skill in the art that a projectile containment chamber will evolve a certain amount of particulate matter and fragments from the repeated impacts of bullets with impact surfaces, and from impacts with residual matter within the chamber. It is desirable to contain and collect these materials for re-use and to prevent their escape to the surrounding environment.

As is discussed above, the chamber 16 is generally closed with the exception of an ingress 30 and an egress 44. This containment generally prevents the escape of lead. A collection tray 54 is disposed beneath the egress to collect the emissions. The area between the collection tray 54 and the chamber can be constructed to be relatively air-tight. Other relatively minor areas where airborne emissions can escape from the chamber 16, such as the ingress 30 and areas around moveable plates, can be checked by means to remove the emissions. One means for removing airborne particulate matter from the chamber is the introduction of a liquid or colloidal suspension to the chamber as a mist, through an injection port 56. The liquid or colloidal suspension is forced under pressure through the injection port 56 by a pump (not depicted) or some other apparent means, or means which may become apparent; and delivered by a hose or pipe or other apparent means, or means which may become apparent.

Another means for removing airborne particulate matter from the chamber, is to draw a negative pressure on the chamber, and filter the particulate matter from the air drawn from chamber 16. This is accomplished in the preferred embodiment by drawing air from the collection tray 54 by means of a hose 60, which is connected to an air pump 62. The air pump 62 draws air from the chamber through the hose 60. An in-line filter 64 is disposed in the hose to collect the particulate matter. It will be appreciated that a filter capable of removing the particulate matter desired to be removed, and which is compatible with any liquid or colloid present, and which is compatible in-use with the working capacities of the air pump 62, should be chosen. The filtered air is then exhausted to ambient air.

The chamber is supported by four legs 68 attached, two to each, to end plates 40–42. The legs 68 extend from the support surface (not depicted), to the bottom of end plates 40–42.

The lower channel plate 22 is supported by six legs 72 extending from points on the channel plate 22, to the support surface (not depicted), and thereby support the lower channel plate 22 without obstruction of the wide opening of the channel 24.

Two cantilever beams 74 are attached to four cantilever supports 70 at the top of end plates 40–42, two each, so as to extend from generally over the Chamber 16, to a position above the upper channel plate 20. Cantilever tethers 76 attach the upper channel plate 20 to the cantilever beams 74, and provide support for the same.

Figure 3:
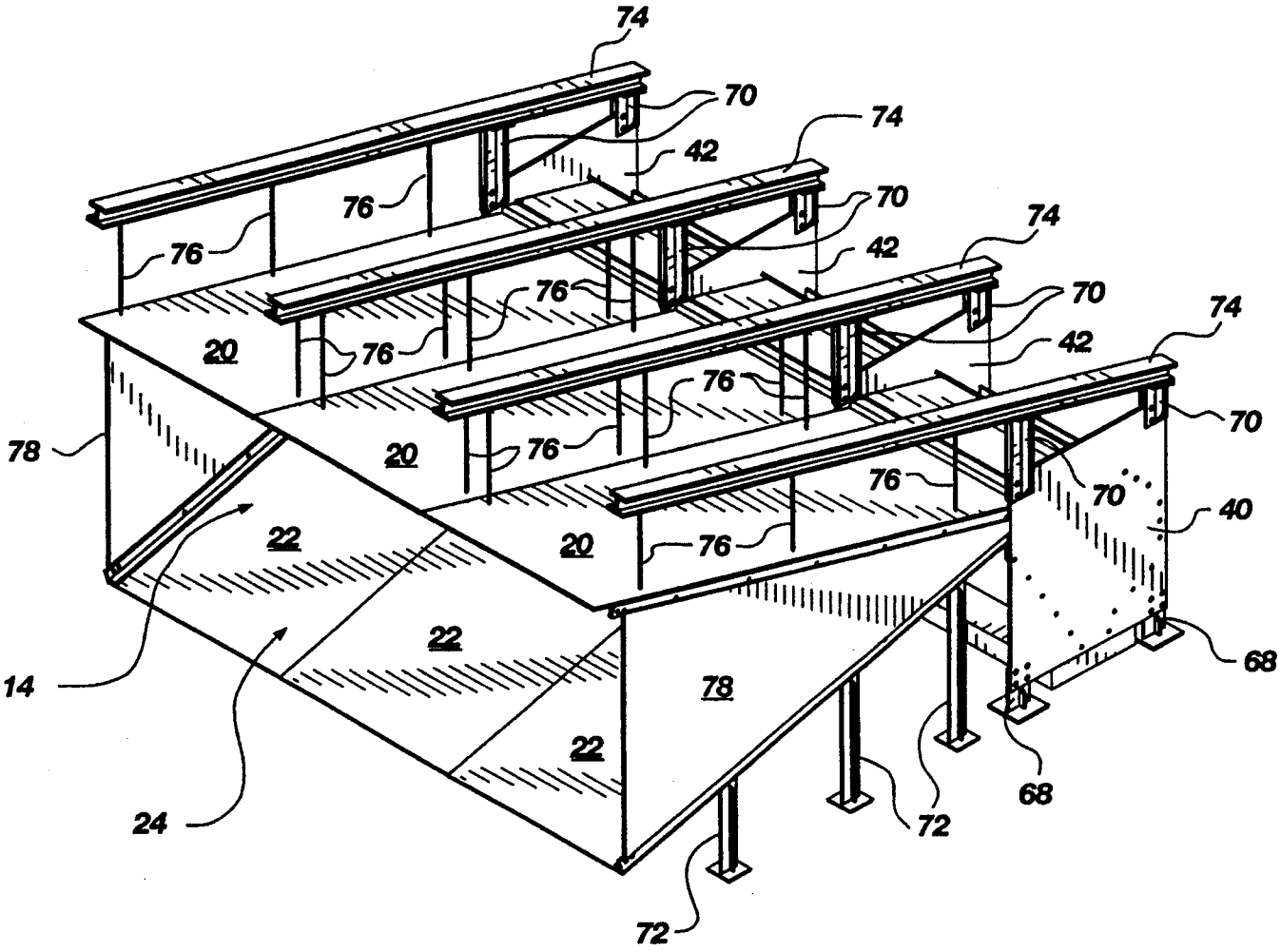
FIG. 3 is a perspective view of 3 of the bullet stop and containment chambers of FIG. 1, arranged in horizontal series.

Depicted in FIG. 3, is an arrangement of the bullet stop and containment chamber described, with 3 units in horizontal series. The absence of supports for the channel 14 or its components within the area of the horizontal zone of projectile travel 12 is apparent. The use of cantilever beams 74 and tethers 76 to support the upper channel plate 20, allows the entire wide opening 24 of the channel 14 to remain open and be utilized for projectile travel without obstruction. Vertical plates 78 are placed on the ends of the series to channel projectiles into the opening of the chamber 16, and to prevent the exit of projectiles out the end of the series.

The present invention represents a significant advance over conventional bullet stop and containment apparatus. It is noted that many of the advantages of the present invention accrue due to the fabrication of the unit primarily from flat plates which can be readily purchased, stocked, inventoried, shipped, and fabricated; the unit is readily serviceable; projectiles are decelerated in increments; and the unit has effective means for containing and collecting the by products of projectiles, including fragments and particulate matter. Those skilled in the art will appreciate from the preceding disclosure that the objectives stated above are advantageously achieved by the present invention.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A bullet stop and containment chamber having a generally horizontal zone of projectile travel, said bullet stop and containment chamber comprising:

a channel to guide projectiles to a chamber ingress, said channel including upper and lower guide plates oriented at acute angles from the horizontal zone of projectile travel, said channel having a first opening with a width and a second opening with a lesser width, wherein projectiles travel from the first opening to the second opening, the second opening substantially coextensive with the chamber ingress;

a first impact plate with first and second ends, said first impact plate oriented at a first angle from the horizontal zone of projectile travel, which first angle is at least as great as the acute angle of the upper guide plate, said first impact plate extending from the chamber ingress to a successive impact plate;

at least one successive impact plate with first and second ends;

a terminal impact plate with first and second ends;

said at least one,successive impact plate oriented in succession with other impact plates with primary and secondary angles, the primary angle at the intersection of a successive impact plate and a preceding impact plate and the secondary angle at the intersection of each impact plate and its successive impact plate, wherein the primary angle is at least as great as the secondary angle;

said terminal impact plate extending from the last successive impact plate to the chamber ingress;

said first end of the primary impact plate, first end of the at least one successive impact plate, and first end of the terminal impact plate being adjacent a first end plate;

said second end of the primary impact plate, second end of the at least one successive impact plate, and second end of the terminal impact plate being adjacent a second end plate; and, said first impact plate, at least one successive impact plate, terminal impact plate, and first and second end plates forming a chamber, said chamber having a space between the primary impact plate and, the terminal impact plate, said space forming the chamber ingress, and said chamber having an egress.

2. A bullet stop and containment chamber as in claim 1 further comprising a Collection tray disposed below the chamber egress, said tray for collection of projectiles.

3. A bullet stop and containment chamber as in claim 1 wherein at least one impact plate is releasably attached to the first and second end plates.

4. A bullet stop and containment chamber as in claim 1 further comprising cantilever means for supporting said upper guide plate of the channel.

5. A bullet stop and containment chamber as in claim 1 further comprising primary impact plate containment means for retaining the primary impact plate within a zone of movement, said movement to assimilate inertial energy from a projectile upon impact with the primary impact plate.

6. A bullet stop and containment chamber as in claim 1 further comprising means for removing airborne particulate matter from the chamber.

7. A bullet stop and containment chamber as in claim 6 wherein the removing means comprises means for releasing moisture within the chamber.

8. A bullet stop and containment chamber as in claim 1 further comprising means for exerting negative air pressure on the chamber to remove airborne particulate matter from the chamber and limit escape of airborne particulate matter through the chamber ingress.

9. A bullet stop and containment chamber as in claim 8 further comprising means for filtering airborne particulate matter.

10. A bullet stop and containment chamber for stopping the forward momentum of projectiles traveling in a generally horizontal zone of projectile travel, said bullet stop and containment chamber comprising:

a channel to guide projectiles to a chamber ingress, said channel including upper and lower guide plates oriented at acute angles from the horizontal zone of projectile travel, said channel having a first opening with a width and a second opening with a lesser width, wherein projectiles travel from the first opening to the second opening, the second opening substantially coextensive with the chamber ingress;

primary planar impact means to obstruct the generally horizontal zone of projectile travel, said primary planar impact means adjacent to the second opening of the channel;

sequential planar impact means for sequentially arresting the travel of projectiles;

a plurality of end plates;

wherein the primary planar impact means, sequential planar impact means and end plates define the perimeter of chamber means to arrest and contain projectiles, said chamber means having an ingress complementary to and adjacent to the second opening of the channel means for receiving projectiles, and said chamber means having egress means for the discharge of projectiles whose inertial momentum has been arrested within the chamber means; and cantilever means for supporting said upper guide plate of the channel.

11. A bullet stop and containment chamber as in claim 10 wherein the cantilever means comprises at least one elongate support member which rests on the containment means.

12. A bullet stop and containment chamber as in claim 10 wherein the cantilever means comprises at least one elongate support member and a plurality of legs commonly supporting the elongate support member and the containment means.

13. A bullet stop and containment chamber as in claim 10 further comprising means for removing airborne particulate matter from the chamber.

14. A bullet stop and containment chamber as in claim 10 wherein the primary planar impact means is releasably attached to the chamber means.

15. A bullet stop and containment chamber as in claim 10 further comprising primary planar impact means retaining means for retaining the primary planar impact means within a zone of movement, said movement to assimilate inertial energy from a projectile upon impact with the primary impact plate.

* * * * *